United States Patent [19]

Dobrusskin et al.

[11] Patent Number: 4,647,814

[45] Date of Patent: Mar. 3, 1987

[54] HIGH-POWER, HIGH-PRESSURE METAL HALIDE DISCHARGE LAMP WITH IMPROVED SPECTRAL LIGHT DISTRIBUTION

[75] Inventors: Alexander Dobrusskin, Taufkirchen; Bernd Lewandowski; Walter Kiele, both of Munich, all of Fed. Rep. of Germany

[73] Assignee: Patent-Treuhand Gesellschaft fur elektrische Gluhlampen mbH, Munich, Fed. Rep. of Germany

[21] Appl. No.: 755,290

[22] Filed: Jul. 15, 1985

[30] Foreign Application Priority Data

Jul. 24, 1984 [DE] Fed. Rep. of Germany ..... 3427280

[51] Int. Cl.[4] ..... H01J 61/18

[52] U.S. Cl. ..... 313/641

[58] Field of Search ..... 313/640, 641

[56] References Cited

U.S. PATENT DOCUMENTS

| | | | |
|---|---|---|---|
| 3,334,261 | 8/1967 | Butler et al. | 313/641 |
| 3,530,327 | 9/1970 | Zollweg et al. | 313/640 X |
| 3,654,506 | 4/1972 | Kühl et al. | 313/641 |
| 3,798,487 | 3/1974 | Zollweg et al. | 313/641 X |
| 3,842,307 | 10/1974 | Dobrusskin et al. | 313/640 X |
| 4,134,039 | 1/1979 | Vida et al. | 313/640 |

FOREIGN PATENT DOCUMENTS

| | | | |
|---|---|---|---|
| 0032338 | 3/1980 | Japan | 313/641 |

*Primary Examiner*—Palmer C. DeMeo

*Attorney, Agent, or Firm*—Frishauf, Holtz, Goodman & Woodward

[57] ABSTRACT

To increase the power output of a high-pressure metal halide discharge lamp having a fill of mercury and at least one noble gas, and rare-earth halides which include at least one of: holmium; dysprosium, preferably present, each, of from 0.01 to 2.4 mg/cm$^3$ of the discharge vessel, a gadolinium halide, present of from 0.01 to 2.3 mg/cm$^3$ of the discharge vessel is additionally included in the fill. The discharge vessel is made of quartz, the electrodes of tungsten, and, in an example, a lamp operating at 12 kW, with 380 V power supply at 65 A is obtainable, the light output being comparable to that of daylight based on CIE standard D 60, with a color temperature of 6000° K. so that an overall color temperature of about 5600° K. is obtainable when the lamp is installed in a customary fixture, for example used in theatrical, film or television illumination application. The preferred halogens are bromium and/or iodine, in which the halogen is present in excess over the rare-earth - halide stoichiometric relationship. The specific arc power obtainable is between 1000 to 5000 W/cm, with a wall loading of between 50 to 120 W/cm$^2$.

4 Claims, 2 Drawing Figures

CIE
D (60)
LIGHT INTENSITY (%)
100
90
80
70
60
50
40
30
20
10
0
350
400
450
500
550
600
650
700
750
780
WAVE LENGTH (nm)

HIGH-POWER, HIGH-PRESSURE METAL HALIDE DISCHARGE LAMP WITH IMPROVED SPECTRAL LIGHT DISTRIBUTION

Reference to related publications:
U.S. Pat. No. 3,654,506
British Pat. No. 1,376,509

The present invention relates to a metal halide high-pressure discharge lamp having a power rating of 4 kW, or more, and more particularly to a rare-earth halogen mercury vapor discharge lamp, in which the discharge or arc is confined within an arc vessel or a discharge vessel of high temperature resistant light transmissive material, such as quartz glass for example.

BACKGROUND

Various types of arc discharge lamps have been proposed, in which a single arc vessel or discharge vessel retains electrodes within which an arc can be struck, the vessel also retaining a fill which includes mercury, a noble gas, and rare-earth halides. Typically, the rare-earth halides include holmium and/or dysprosium. Such lamps have a specific wall loading of between 50 to 120 W/cm$^2$, and a specific arc power of between 1 kW and 5 kW/cm.

U.S. Pat. No. 3,654,506 and British Pat. No. 1 376 509 describe high-pressure discharge lamps retaining mercury vapor within the discharge vessel—when in operation—and additionally rare-earth halides, particularly halides of dysprosium and/or holmium and/or thulium. These lamps have a light output of over 85 lm/W. The light output, with respect to spectral distribution, of such lamps should approach daylight as closely as possible. Consequently, the color should be about 6000° K., with a color rendering index Ra of 90 or better. Lamps of this type are used particularly for illumination of stages for theatrical and similar performances, for film studios, television studios and the like, or in any other installation where the color temperature should approach that of daylight as closely as possible, and where excellent color rendition is important.

Lamps of this type which have a rated power of below about 4 kW can be made, and which also have the desired color spectral distribution of the light output. It has been found, however, that as the power of such lamps is increased, with the same composition of the halides, the color temperature of the light decreases markedly, so that the spectral composition of the light output will no longer satisfy the requirements placed on such lamps.

A color temperature of about 6000° K. is necessary since the actual output of the light changes somewhat when the lamps are installed in suitable lamp fixtures or illumination systems. Installing such lamps in illumination systems or fixtures causes the color temperature of the emitted light to drop by several 100° K. In order to obtain good color balance and good color rendition of scenes illuminated by the lamps used for film recording, for television use or the like, it is necessary that the illuminating light have a color temperature of about 5600° K. Consequently, the lamps by themselves, external of an entire illumination system and/or illuminating light fixtures and the like, should have a color temperature which is approximately in the order of 6000° K.

THE INVENTION

It is an object to provide a metal halide high-pressure discharge lamp which may have a rated power of 4 kW and over, and preferably substantially over 4 kW, in which the color temperature will be in the order of about 6000° K., with excellent color rendition and overall spectral light distribution, in short, to improve metal halide high-pressure lamps by increasing the rated power thereof without, however, degrading the spectral distribution or color temperature of the resulting light output.

Briefly, in accordance with the invention, the fill in the otherwise standard arc tube includes gadolinium halide; such a lamp will have a color temperature of about 6000° K. and a color index Ra of over 90.

The emission of radiation of metal halide high-pressure discharge lamps having a rated power of 4 kW and over is determined essentially by transition of highly excited states that is, Rydberg atoms, as well as by radiation transitions of multiple charged ions. Free, inner layers of rare earth, or inner layers which are not completely occupied, for example, Ho: 4f, 5d, 5f (in LS coupling), due to the extensive multiplicity of the terms, result in an extensive line distribution, that is, quasi a continuous spectral light output. Yet, pre-computation of the spectral characteristics of such lamp cannot, logically, be carried out since the numerous and complex interdependence of the various parameters does not permit clear prediction of results with respect to chromaticity coordinates and color rendition of the overall lamp.

Various experiments were made with different compositions of the fill within the arc tube of high-pressure lamps having rated power between 4 kW and about 14 kW. Fill elements of holmium, dysprosium, as well as gadolinium were investigated. It has been found, surprisingly, that for light outputs of over 80 lm/W, and with a color temperature of 6000° K., and a color rendition index of over 95, the discharge vessel should have 0.01 to 2.3 mg gadolinium and 0.01 to 2.4 mg holmium and/or dysprosium—all per cm$^3$ of the volume of the discharge vessel.

A well functioning halogen cycle is of particular importance to obtain long average lifetime of the lamp. Optimal operation for an average lifetime of about 250 hours is obtained with the above lamp when the discharge vessel utilizes bromium and/or iodine as the halogen therein; further, the elements should be present in excess of stoichiometric condition with respect to the rare-earth halide compounds, so that an excessive halogen presence will occur within the discharge vessel.

To obtain a diffuse arc region on the electrodes, cesium is added to the discharge vessel this results in a diffuse arc spot. The quantity of cesium must be so measured that it is just sufficient to stabilize the arc. It may not exceed this quantity, however, since cesium accelerates devitrification of the glass. The highly loaded arc tubes will have lamp bulb or arc vessel temperatures in the order of about 900° C., which is only somewhat below the transformation point for quartz glass which is at about 1100° C.

DRAWINGS

FIG. 1 is a schematic side view of a high-pressure lamp in accordance with the present invention, omitting all components not necessary for an understanding of the present invention; and FIG. 2 is a graphic illustration of the spectral distribution of light emitted from the lamp of FIG. 1, with a second graph, for comparison purposes, illustrating the spectral distribution of average daylight.

DETAILED DESCRIPTION

Figure 1:
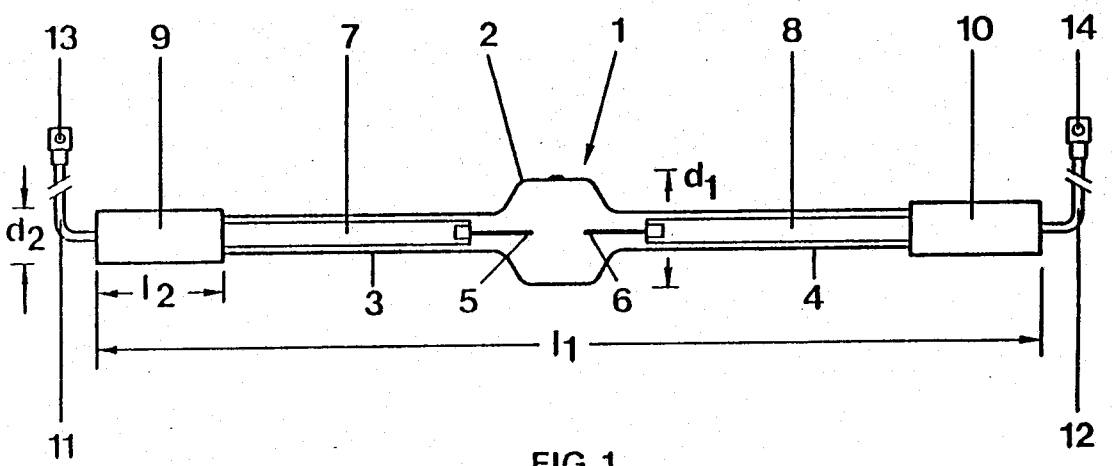

The metal halide high-pressure discharge lamp 1 of FIG. 1 has a power rating of 12 kW. The discharge vessel 2 is made of quartz, with a wall thickness of 5 mm, an outer diameter $d_1$ of 65 mm, and two lamp shafts 3, 4. The overall length $l_1$, including the shafts 3 and 4, is somewhat less than ½ meter, and in the example illustrated 46½ cm.

The electrodes 5, 6 are made of tungsten and pinch-sealed vacuum-tightly, by molybdenum foils 7, 8 in the lamp shafts 3, 4, by a melt seal. They are connected by suitable electrical connection with bases 9, 10, which have a diameter $d_2$ of 1 inch (2.5 cm) and a length $l_2$ of 6 cm. The bases 9, 10 are of standard size, and, for example, of the standard designation K 25s. Connecting cables 11, 12 of about 15 cm length, with terminals 13, 14 extend from the bases 9, 10.

The discharge vessel 2 has a volume of 105.5 $cm^3$ and an electrode tip spacing, or distance of 32 mm. This particular volume retains a fill of the following composition:

12.6 mm Ho
12.0 mg Gd
60.6 mg CsBr
90.0 mg $HgBr_2$ and
70.7 mg $HgI_2$, as well as additionally:
939.6 mg elementary Hg and 400 hPa (hecto Pascal, i.e., $10^2$ Pascal) Ar.

The light output of the described metal halide high-pressure discharge lamp 1 will have a color temperature of 6000° K., a color-rendition index Ra of over 95, and an output of 84 lm/W. The lamp is supplied with a nominal voltage of 380 V, in operating position p 15, and at an arc voltage of 225 V will require 65 A of current.

Figure 2:
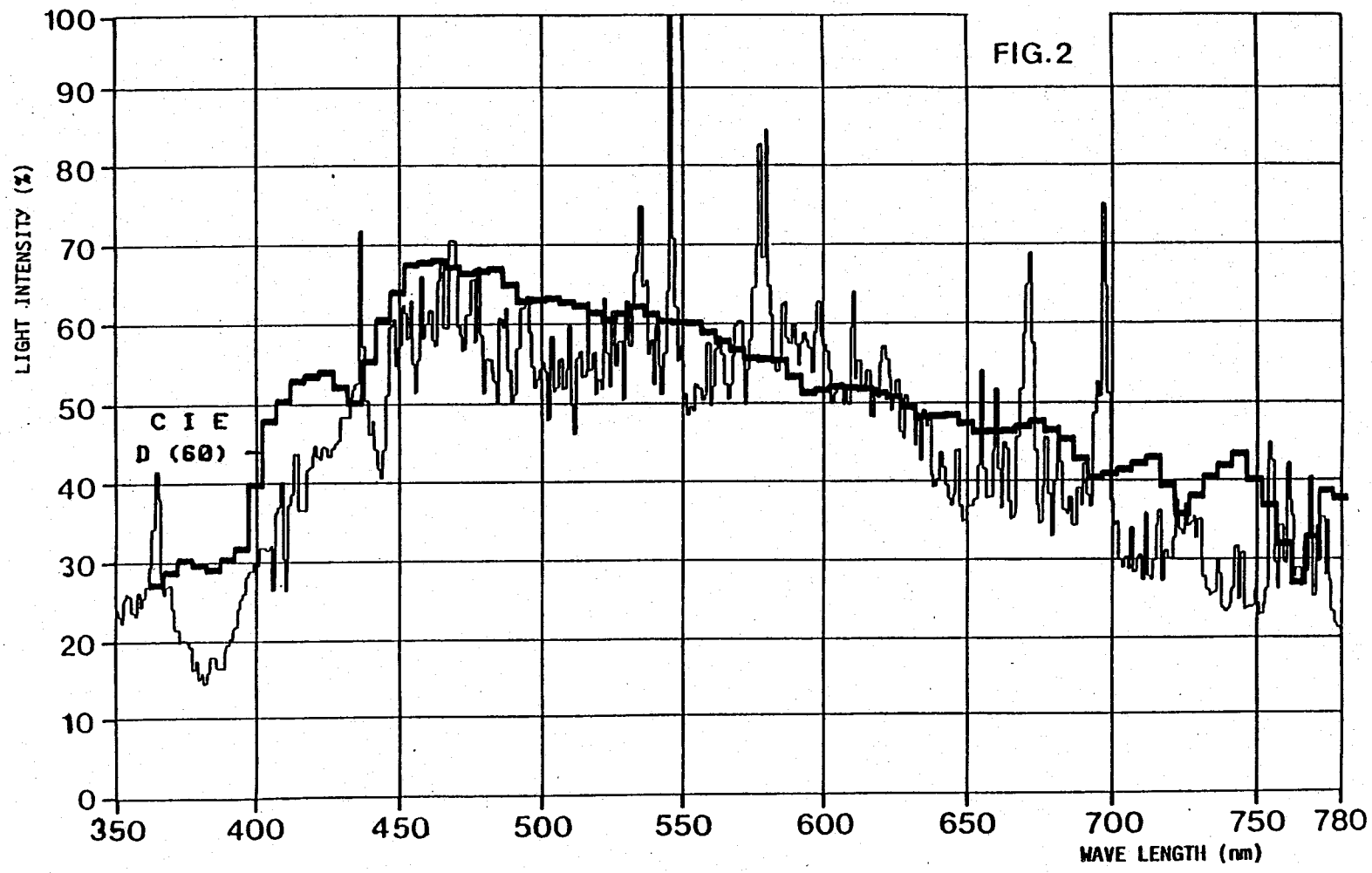

The spectral distribution of the light in the lamp, and for comparison of daylight, is shown in FIG. 2. The distribution is shown for wave lengths between 350 and 780 nm. The daylight spectrum D (60), in accordance with CIE standards, with a color temperature of 6000° K. is shown in heavy-line representation in FIG. 2; the light line graph of FIG. 2 illustrates the light output from the lamp in accordance with the present invention. As the graph of FIG. 2 clearly shows, the spectral distribution and light output, that is, the individual spectral lines of the lamp in accordance with the present invention, essentially conforms to the daylight curve of 6000° K. In the graph of FIG. 2, the abscissa represents wave length in nm, and the ordinate percent of light intensity at the respective wave lengths.

A 12 kW metal halide high-pressure discharge lamp, in an optimized version, had these characteristics: discharge vessel 2: volume 112 $cm^3$; electrode tip spacing, or distance 3.4 cm; fill of the discharge vessel 2:

10.6 mg Dy
15.3 mg Gd
40.5 mg CsBr
114.8 mg $HgBr_2$
49.5 mg $HgI_2$
889.4 Hg and
400 hPa Argon Light output data:
color temperature: 6000° K.
color rendering index Ra: 95
light output: 92 lm/W.

We claim:

1. A daylight-balanced high-power high-pressure metal halide discharge lamp (1) with a rated power of at least 4 kW having
a unitary discharge vessel or arc tube (2) of high temperature resistant transparent material;
two electrodes (5,6) of high temperature resistant metal sealed into the discharge vessel or arctube;
and a fill in the discharge vessel or arc tube,
wherein the lamp has a specific wall loading of from 50 to 120 W/$cm^2$, and a specific arc power of from between 1–5 kW/cm;
and wherein,
to obtain a color temperature of about 6000° K. and a color rendering index Ra of higher than about 90, the fill within the discharge vessel or arc tube (2) consists of mercury, at least one noble gas and at least one of
holmium halide and
dysprosium halide,
present in a quantity of from about 0.01 to 2.4 mg per cubic centimeter of the discharge vessel or arc tube (2); and
gadolinium halide
present in a quantity of from 0.01 to 2.3 mg per cubic centimeter of the volume of the discharge vessel or arc tube; and
wherein the halogen component of said halides consists of at least one of: bromine, iodine.

2. A lamp according to claim 1, wherein the halogen is present in an excess exceeding the stoichiometric relation of the rare-earth halides.

3. A lamp according to claim 1, wherein the fill in the discharge vessel or arc tube (2) further includes cesium, in a quantity just sufficient for diffusing the arc region on the electrodes, when the lamp is in operation.

4. A lamp according to claim 1, wherein said lamp has a rated power of 12 kilowatts;
the discharge vessel has a volume of 112 cubic centimeters;
the electrodes have an electrode tip spacing, or distance of 3.4 cm;
and the fill of the discharge vessel or arc tube comprises:
10.6 mg Dy
15.3 mg Gd
40.5 mg CsBr
114.8 mg $HgBr_2$
49.5 mg $HgI_2$
889.4 mg Hg and 400 hPa Argon.

* * * * *